US007258409B2

(12) United States Patent
Kunihiro

(10) Patent No.: US 7,258,409 B2
(45) Date of Patent: Aug. 21, 2007

(54) INKJET PRINTING APPARATUS AND CONTROL METHOD FOR THE SAME

(75) Inventor: Shunichi Kunihiro, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 10/767,716

(22) Filed: Jan. 30, 2004

(65) Prior Publication Data

US 2004/0183846 A1 Sep. 23, 2004

(30) Foreign Application Priority Data

Jan. 31, 2003 (JP) ..... 2003-024323

(51) Int. Cl.
*B41J 29/38* (2006.01)

(52) U.S. Cl. ..... 347/14; 347/16

(58) Field of Classification Search ..... 347/4, 347/139, 8, 40–41, 14, 16, 19, 150
See application file for complete search history.

(56) References Cited

U.S. PATENT DOCUMENTS 5,988,784 A * 11/1999 Takemura et al. ..... 347/8
6,267,519 B1 7/2001 Otsuki et al.
6,429,886 B2 8/2002 Ohki
6,527,360 B2 * 3/2003 Otsuki et al. ..... 347/19
6,775,022 B2 8/2004 Noyes et al.
2003/0035021 A1 * 2/2003 Masuyama et al. ..... 347/40
2004/0080554 A1 * 4/2004 Kim ..... 347/12

FOREIGN PATENT DOCUMENTS

EP 1 078 771 2/2001
JP 2001-129985 5/2001

* cited by examiner

*Primary Examiner*—Stephen Meier
*Assistant Examiner*—Jason Uhlenhake
(74) *Attorney, Agent, or Firm*—Fitzpatrick, Cella, Harper & Scinto

(57) ABSTRACT

An inkjet printing apparatus, having a carriage incorporating an inkjet printhead where nozzles for discharging ink are arranged in a predetermined direction, performs printing by scanning the carriage with respect to a printing medium in a direction orthogonal to the nozzle arrangement direction. The apparatus includes first and second conveyance sections, which are arranged at the front and rear of the area scanned by the printhead, for holding and conveying the printing medium. When the printing medium is held only by one of the conveyance sections, nozzles to be used for printing are selected from the nozzles satisfying the condition that the distance between a discharge surface of the nozzle and a printing surface of the printing medium falls within a predetermined range, in accordance with a position of the printing medium with respect to the printing-medium conveyance direction.

5 Claims, 18 Drawing Sheets

INKJET PRINTING APPARATUS AND CONTROL METHOD FOR THE SAME

FIELD OF THE INVENTION

The present invention relates to an inkjet printing apparatus, and more particularly, to a technique of preventing deterioration of printing quality at the time of printing an area where a distance between a discharge surface of a printhead and a printing surface of a printing medium is unstable.

BACKGROUND OF THE INVENTION

A printer capable of printing desired information such as texts and images on a sheet-type printing medium, e.g., paper, film, and the like, is widely utilized as a data output apparatus in a word processor, a personal computer, a facsimile, and so forth.

Although various printing methods are available for such printer, recently an inkjet printing method has particularly attracted the attention because of its capability to perform non-contact printing on a printing medium such as paper, ease of color printing, and low noise. In general, a serial printing method is widely adopted because of its low cost and ease of downsizing. According to the serial printing method, a printhead for discharging ink in accordance with desired printing data is mounted, and the printhead is reciprocally scanned in the direction orthogonal to the printing medium conveyance direction.

In such printing apparatus, a printing medium is conveyed by conveyance rollers to pass through the interior portion of the printing apparatus. To stably convey the printing medium, it is a general configuration to arrange the conveyance rollers at two locations: the upstream side (paper-feeding side) and downstream side (paper discharging side) of the printing medium conveyance path.

In this configuration, the conveyance rollers serve to stabilize the printing medium in the printing area. The distance between the ink discharge surface of the printhead and the printing surface of the printing medium largely affects ink landing precision, consequently affecting the quality of the image being printed.

For this reason, the two conveyance rollers are arranged to stabilize (hold) the printing medium in a printing area and to stabilize the distance between the ink discharge surface and the printing surface.

However, at the front end or rear end of the printing medium, the printing medium is conveyed by only one of the conveyance rollers. Since printing medium conveyance is largely affected by the shape of the conveyance path, stiffness (flexibility) of the printing medium and the like, the distance between the ink discharge surface and the printing surface becomes unstable, causing deterioration in printing quality.

Conventionally, there were not many demands for printing at the front end or rear end of a printing medium. Therefore, the distance between the ink discharge surface and printing surface has not raised many problems. However, recently there are many printing apparatuses which can print photograph data, recorded by a digital camera or the like, on the entire surface of a printing medium (so-called rimless printing). Along with this trend, there are increasing, demands for preventing deterioration of printing quality at the time of printing an area (front end and rear end of a printing medium) where the distance between the ink discharge surface and the printing surface is unstable.

SUMMARY OF THE INVENTION

The present invention has been proposed in view of the conventional situation, and has as its object to prevent deterioration of printing quality at the time of printing an area where the distance between a discharge surface of a printhead and a printing surface of a printing medium is unstable.

In order to attain the aforementioned object, according to one aspect of the present invention, there is provided an inkjet printing apparatus, having a carriage incorporating an inkjet printhead where nozzles for discharging ink are arranged in a predetermined direction, for performing printing by scanning the carriage over (with respect to) a printing medium in a direction orthogonal to the predetermined direction, comprising: first and second conveyance means, arranged at the front and rear of an area scanned by the printhead, for conveying a printing medium while holding the printing medium; and nozzle setting means for, when the printing medium is held only by one of the conveyance means, setting a nozzle to be used for printing from the nozzles where a distance between a discharge surface of the nozzle and a printing surface of the printing medium falls within a predetermined range, in accordance with a position of a printing medium in a printing-medium conveyance direction.

In other words, according to the present invention, an inkjet printing apparatus, having a carriage incorporating an inkjet printhead where nozzles for discharging ink are arranged in a predetermined direction, performs printing by scanning the carriage over a printing medium in a direction orthogonal to the nozzle arrangement direction, and comprises first and second conveyance means arranged at. the front and rear of the area scanned by the printhead for holding and conveying the printing medium. In this inkjet printing apparatus, when the printing medium is held only by one of the conveyance means, nozzles to be used for printing can be selected from the nozzles where the distance between a discharge surface of the nozzle and a printing surface of the printing medium falls within a predetermined range, in accordance with a position of the printing medium with respect to the printing-medium conveyance direction.

According to this configuration, in a case where a printing medium is conveyed by only one of the conveyance means such as at the front end or rear end of the printing medium, and printing is performed in an area where the distance between a discharge surface of a nozzle and a printing surface of the printing medium is unstable, it is possible to select nozzles satisfying the condition that the distance between the discharge surface and the printing surface falls within a predetermined range, so that printing can be performed without conspicuous deterioration in image quality.

Accordingly, it is possible to prevent deterioration of printing quality at the time of printing an area where the distance between the discharge surface and the printing surface is unstable.

The nozzle setting means may make setting so that the nozzles where a distance between the discharge surface and the printing surface of the printing medium falls within a predetermined range are divided in plural times of scanning.

In this case, during the plural times of scanning, nozzles to be used for printing may be changed, instead of conveying the printing medium by the conveyance means.

The nozzle setting means may make setting to use nozzles at the rear with respect to the conveyance direction for printing a front-end side of the printing medium, and to use nozzles at the front with respect to the conveyance direction for printing a rear-end side of the printing medium.

Further, the nozzle setting means may make setting to use all nozzles when the printing medium is held by both the first and second conveyance means.

Preferably, the nozzle setting means further comprises an association table of a nozzle to be used and a distance with respect to the printing medium conveyance direction for each type of printing medium.

Note that the present invention is realized not only in the form of the above-described inkjet printing apparatus, but also in the form of a control method of an inkjet printing apparatus, a computer program which causes a computer to execute the control method and in the form of a storage medium storing the program.

Other features and advantages of the present invention will be apparent from the following descriptions taken in conjunction with the accompanying drawings, in which like reference characters designate the same or similar parts throughout the FIGS. thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In the following embodiments, a printing apparatus utilizing an inkjet printing system is explained as an example.

In this specification, "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

First Embodiment

Figure 16:
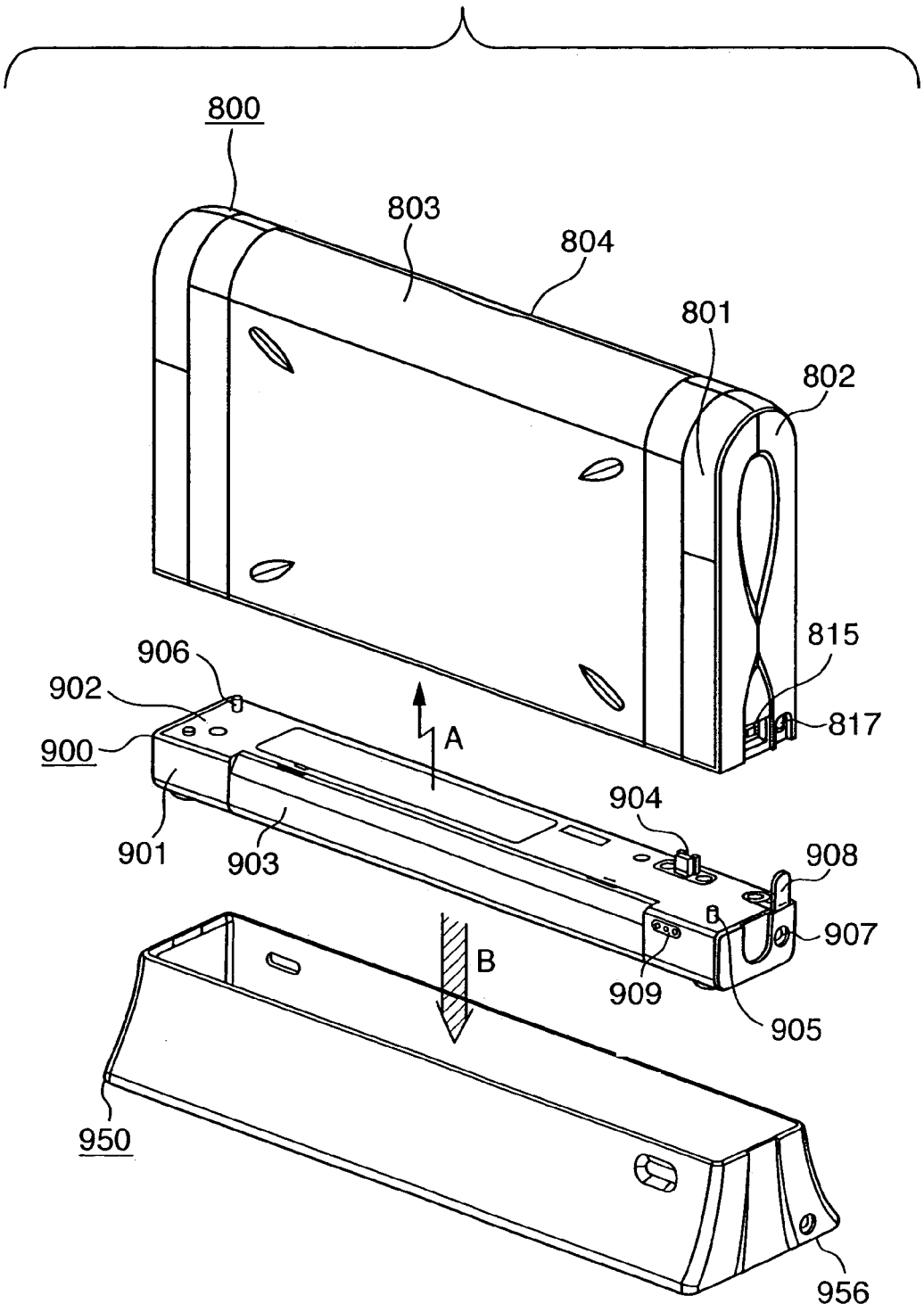
FIG. 16 is a perspective view showing an overall construction of an inkjet printer according to an embodiment of the present invention.

FIG. 16 is a perspective view showing the overall arrangement of a printing apparatus according to an embodiment of the present invention. FIG. 16 shows an inkjet printer serving as a printing apparatus, a battery charger serving as a charging device which incorporates a battery and is detachable from the printer main body, and a cradle serving as a mount for vertically housing the printer and battery-charger while attaching them. A paper sheet will be exemplified as a printing medium for printing by the inkjet printer. The present invention is not limited to this, and can be applied to any printable sheet-like medium.

In FIG. 16, the outer appearance of an inkjet printer 800 is an integral shell structure comprised of an upper case 801, lower case 802, feed cover 803, and feed port cover 804. The inkjet printer 800 takes this form when it is not used (stands still or is carried). The side surface of the inkjet printer 800 has a "DC in" jack (DC power input jack) 817 for inserting an AC adopter cable serving as a power supply, and an I/F connector (interface connector) 815 for connecting a USB cable. The feed cover 803 is a printing sheet supply tray which is opened from the printer main body to support a printing sheet such as a paper sheet in printing.

The outer appearance of a battery charger 900 is comprised of a main case 901, cover case 902, and battery lid 903. The battery lid 903 is detached to open the main case 901, allowing removing a battery pack serving as a battery charger.

The mounting surface (connection surface) of the battery charger 900 to the inkjet printer 800 has a main body connector 904 for electrical connection, and fixing screws 905 and 906 for mechanical attachment and fixing. The battery charger 900 is connected to the printer main body in a direction indicated by an arrow A in FIG. 16 to drive the printer by the battery. The top surface of the battery charger 900 has a charge indicator 909 which indicates the charging state of the battery. The side surface of the battery charger 900 has a "CHG-DC in" jack 907 for inserting an AC adapter cable serving as a power supply, and a cover plate 908 for covering the "DC in" jack 817 of the inkjet printer 800 when the battery charger 900 is attached.

A cradle 950 functions as a mount by inserting it in a direction indicated by an arrow B in FIG. 16 while the battery charger 900 is attached to the inkjet printer 800.

Figure 17:
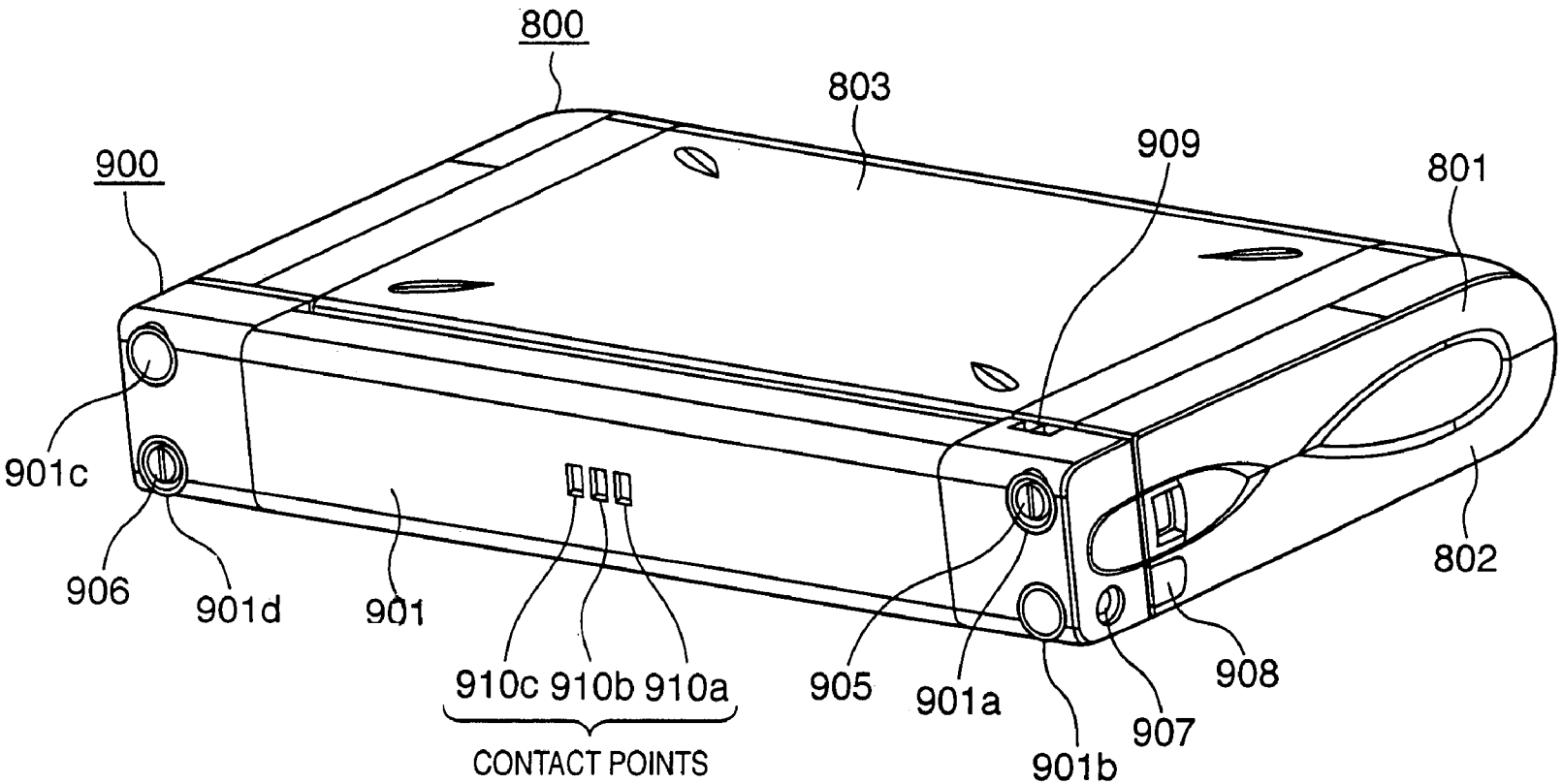
FIG. 17 is a perspective view showing a state where a battery charger is mounted to the inkjet printer shown in FIG. 16.

FIG. 17 is a perspective view showing a state in which the battery charger 900 is mounted on the inkjet printer 800 when the printer back surface and printer top surface are viewed diagonally from the top.

As shown in FIG. 17, the battery charger 900 is attached to the back surface of the inkjet printer 800, and fixed with the fixing screws 905 and 906 to implement a battery-driven printer.

As described above, the "DC in" jack 817 of the inkjet printer 800 is covered with the cover plate 908 of the battery charger 900. In attaching the battery charger 900, the user reliably inserts the AC adapter cable to the "CHG-DC in" jack 907 of the battery charger 900, thus preventing erroneous insertion.

The back surface of the battery charger 900 has four legs 901*a*, 901*b*, 901*c*, and 901*d* on the main case 901. This back surface also has contacts 910*a*, 910*b*, and 910*c* for electrical contact upon attachment to the cradle 950.

As shown in FIG. 17, the charge indicator 909 of the battery charger 900 is arranged at a position where, even when the feed cover 803 is opened, the feed cover 803 does not interrupt visual recognition on the top surface on which the charge indicator 909 can be easily visually recognized in mounting or using the inkjet printer 800.

Figure 1:
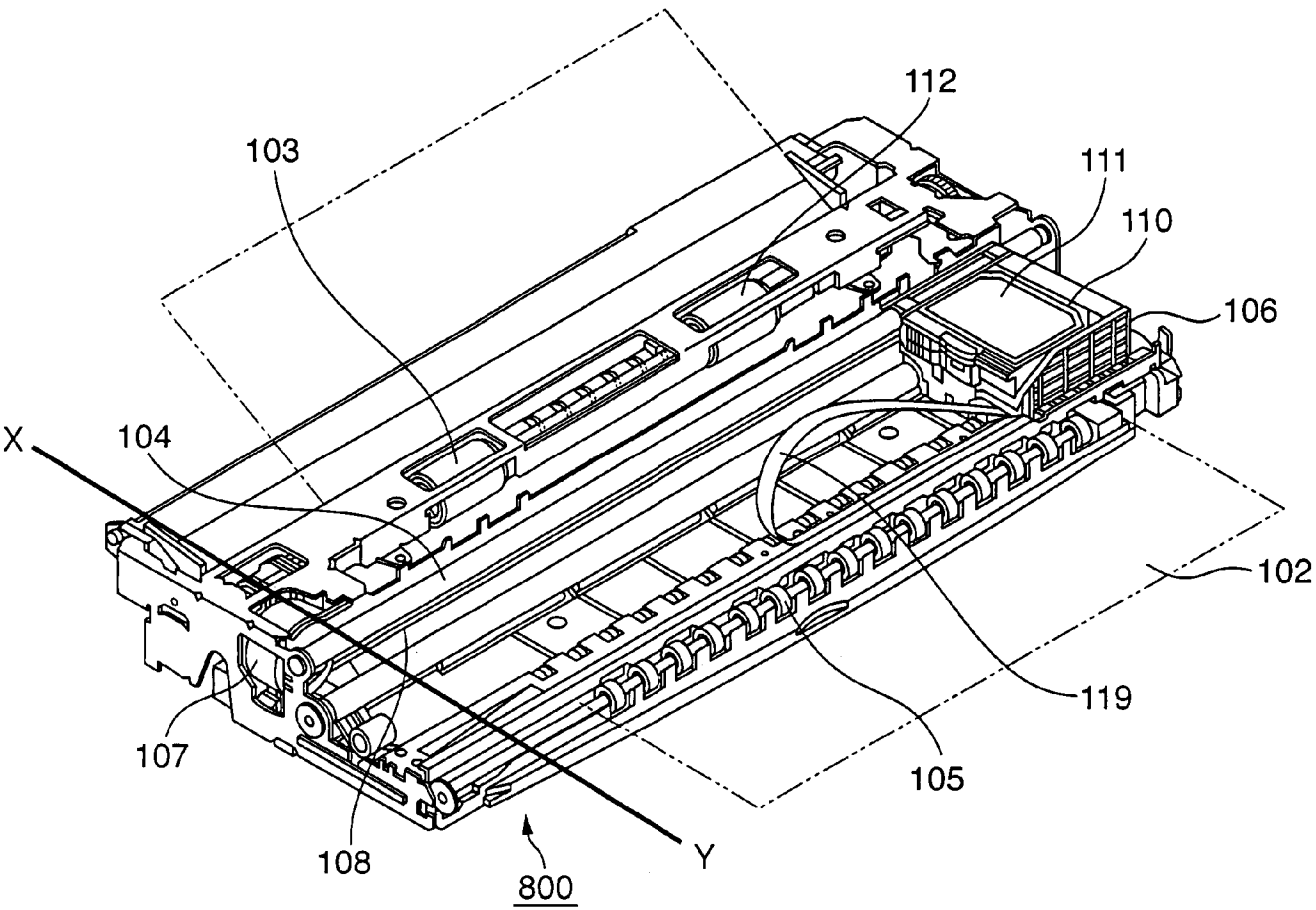
FIG. 1 is a perspective view showing an outer appearance of a printing apparatus according to an embodiment of the present invention.

FIG. 1 is a perspective view showing an outer appearance of an inkjet printing apparatus. An inkjet printing apparatus 800 performs a printing operation by driving various mechanical parts shown in the drawing. A paper sheet 102 serving as a printing medium is inserted to the printer main body by a pickup roller 103, conveyed to a predetermined paper-feed position, then conveyed to a predetermined printing position inside the printer by a conveyance roller 104 to be subjected to a printing operation, and outputted by a discharge roller 105.

While the paper sheet 102 is conveyed, a carriage 106 incorporating a printhead cartridge 110 serving as a printing unit of the printer is driven by a carriage driving belt 108 which transmits power from a carriage driving motor 107, to scan over the paper sheet. In synchronization with the carriage motion, a driving signal and a control signal are transmitted from a flexible cable 109 to the printhead cartridge 110. In accordance with the signals, ink supplied from an ink tank 111 is discharged to the paper sheet 102, thereby performing printing.

While the paper feeding operation is performed by rotating the pickup roller 103, a sensor 112 which detects a paper edge determines existence or absence of a paper sheet. By the detection of the sensor 112, the internal position of the paper sheet is also controlled. The paper sheet, conveyed to the predetermined printing position by the conveyance roller 104, is conveyed also by the driving force of the discharge roller 105.

Figure 2:
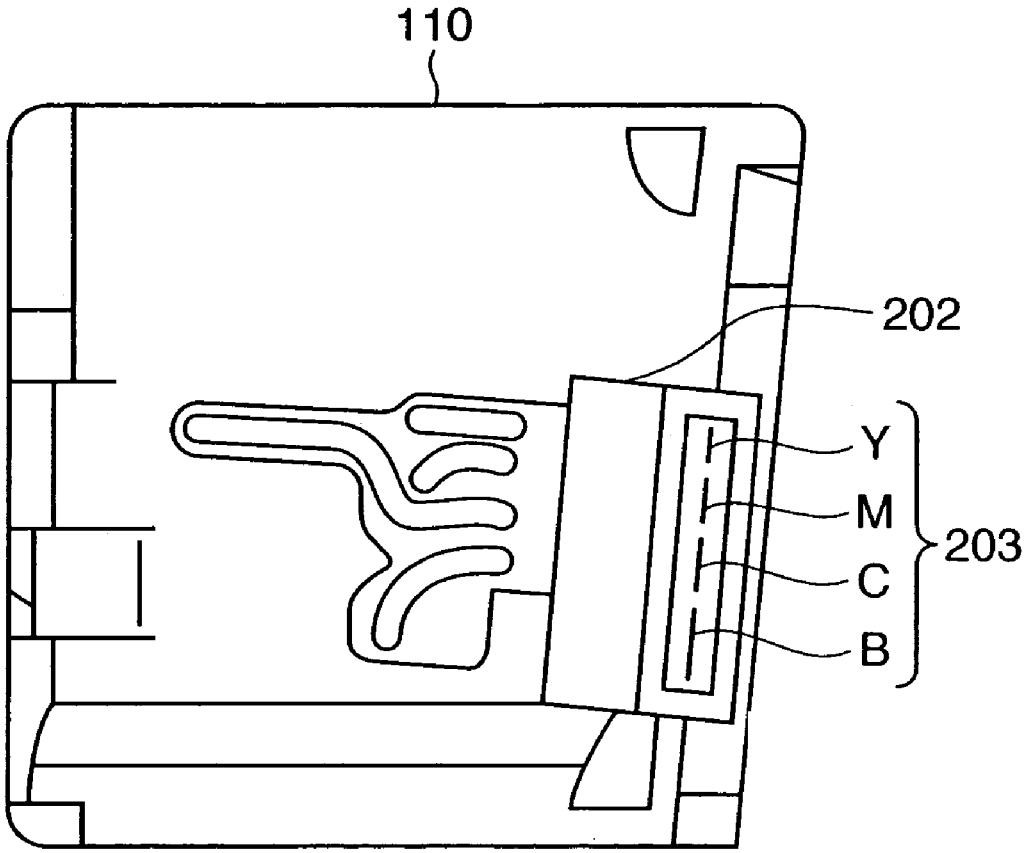
FIG. 2 is a view of a printhead cartridge shown in FIG. 1, which is seen from the printing surface of a paper sheet.

FIG. 2 is a view of the printhead cartridge 110 shown in FIG. 1, which is seen from the printing surface of the paper sheet.

The printhead cartridge 110 comprises-a nozzle unit 202 for discharging ink. The nozzle unit 202 has discharge orifices 203 for discharging yellow (Y), magenta (M), cyan (C), and black (B) inks respectively. The ink of respective colors is discharged from the orifices to the paper sheet, thereby forming a desired image. In other words, each of the nozzles discharging ink serves as a printing element.

For an ink discharging method, a method utilizing heat energy, a method utilizing a piezoelectric device, and the like are known. Any of these methods may be adopted.

Figure 3:
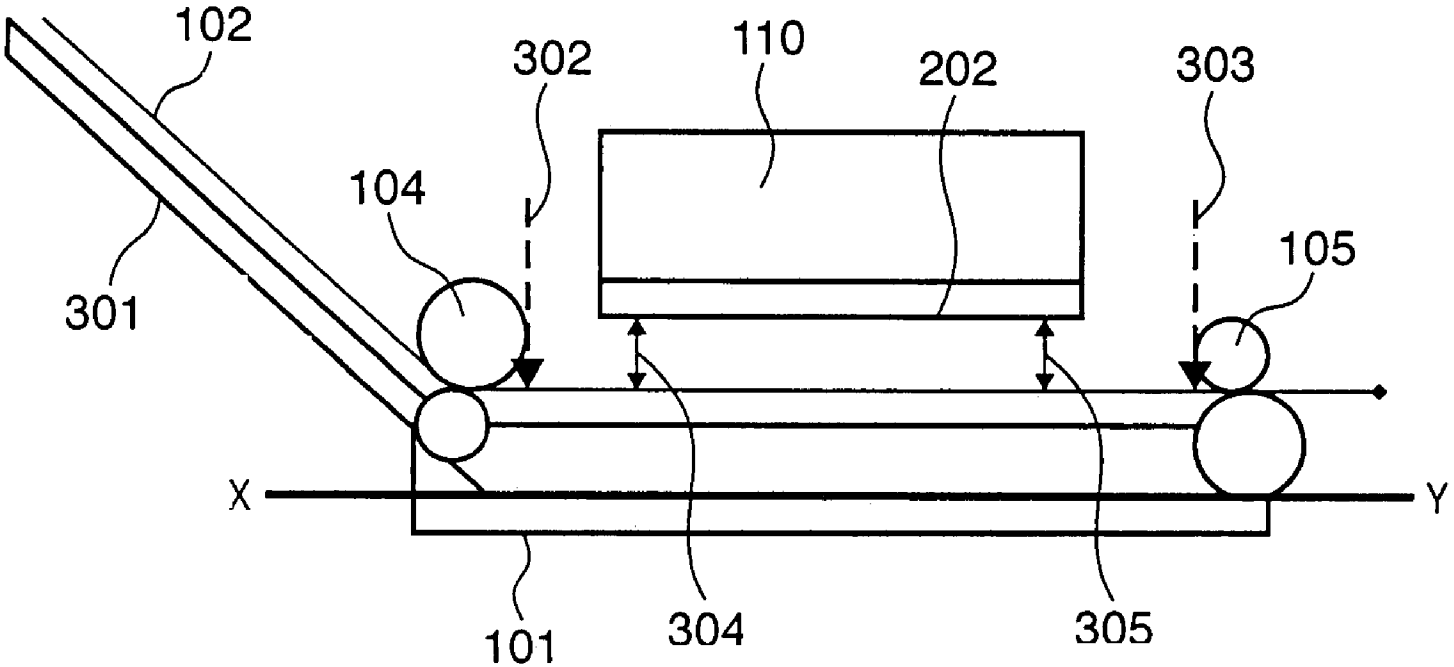
FIG. 3 is a cross-sectional view of the printing apparatus seen from the X-Y surface in FIG. 1, showing the state where a printing medium is held tightly by conveyance rollers and discharge rollers.
Figure 4:
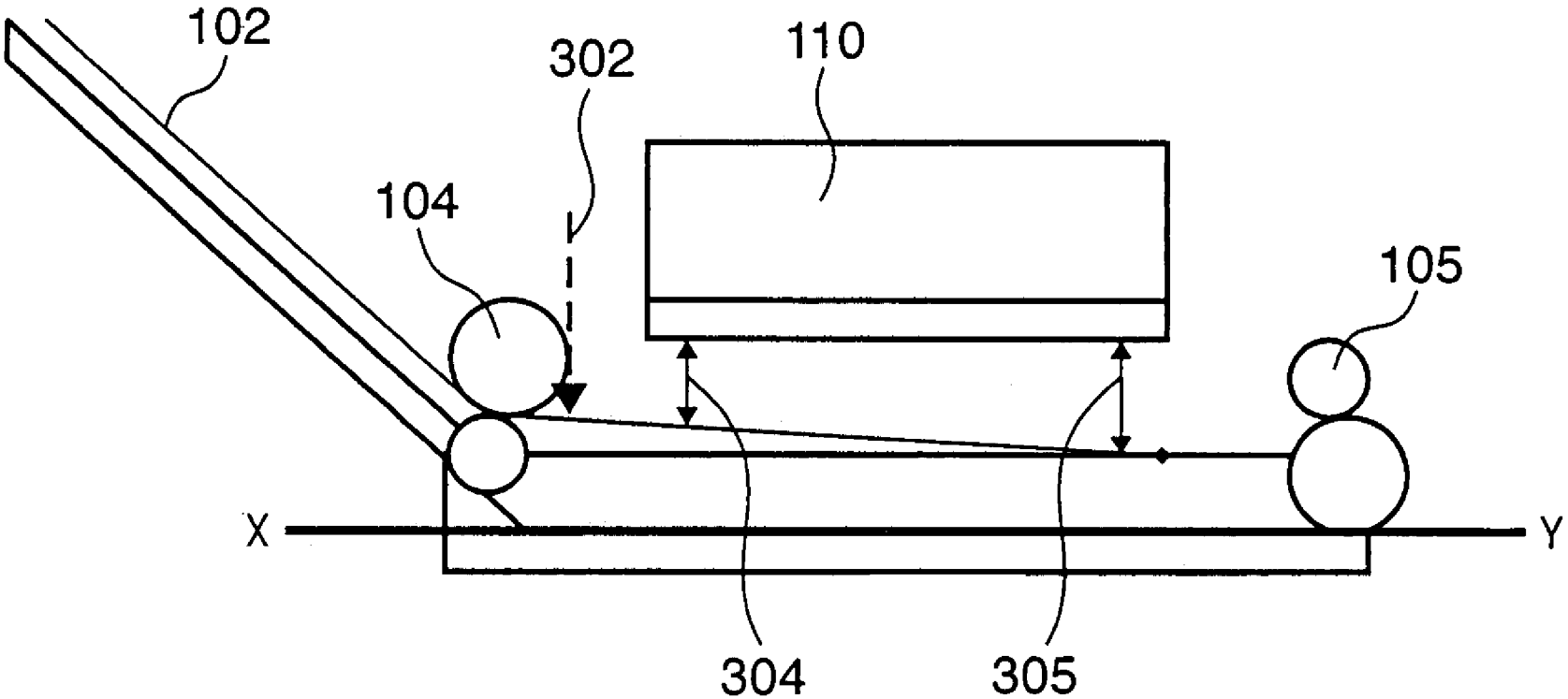
FIG. 4 is a cross-sectional view of the printing apparatus seen from the X-Y surface in FIG. 1, showing the state where a printing medium is held tightly by conveyance rollers only.
Figure 5:
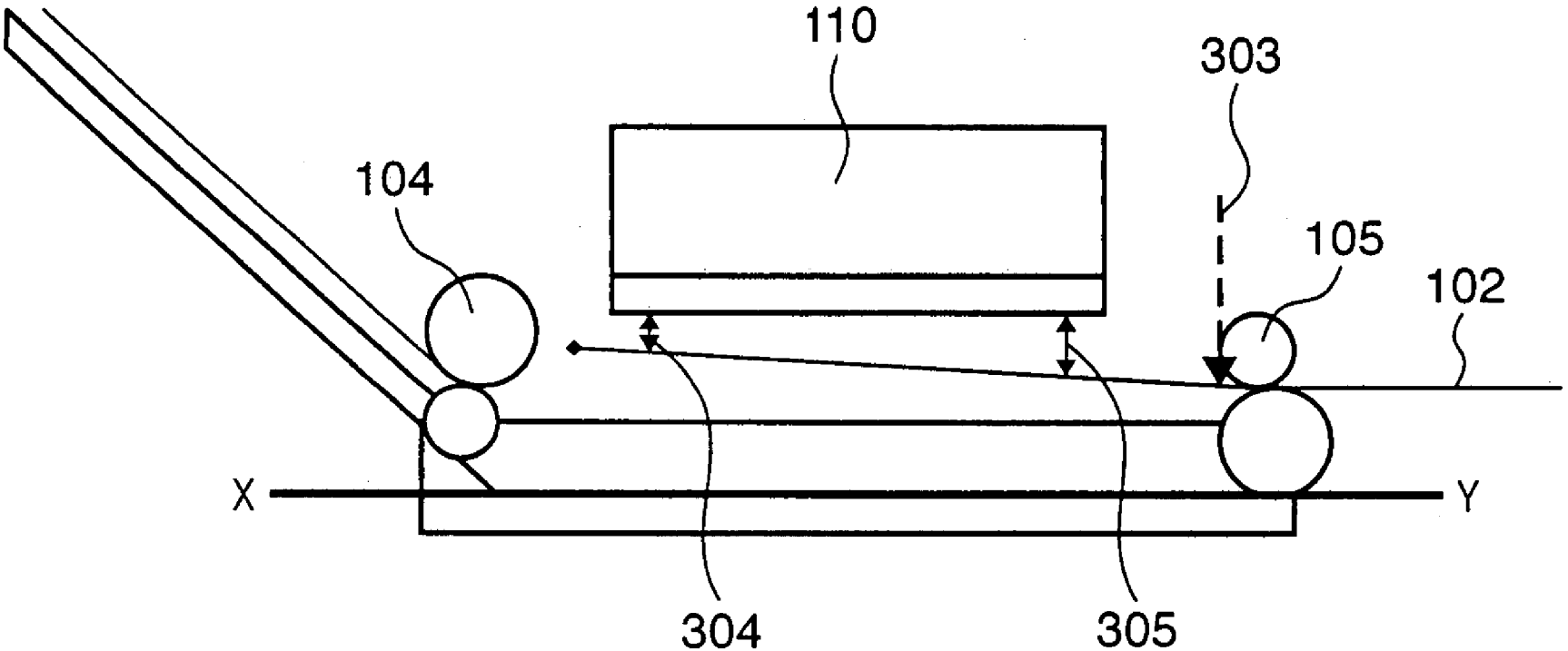
FIG. 5 is a cross-sectional view of the printing apparatus seen from the X-Y surface in FIG. 1, showing the state where a printing medium is held tightly by discharge rollers only.

FIGS. 3 to 5 are cross-sectional views seen from the X-Y surface in FIG. 1, which show the construction of the printing medium conveyance mechanism of the above-described printing apparatus.

The paper sheet 102, serving as a printing medium and being set in a paper-feeding tray 301, is conveyed by the conveyance roller 104 and discharge roller 105 from direction X to direction Y inside the printing apparatus. The conveyance roller 104 and discharge roller 105 respectively consist of a pair of rollers for tightly holding the paper sheet. During print scanning, ink is discharged from the nozzle unit 202 while driving the carriage incorporating the printhead cartridge 110 in the direction orthogonal to the paper conveyance direction. The print scanning and conveyance of the paper sheet 102 are performed alternately to perform printing on a sheet of paper.

FIG. 3 shows a state where the paper sheet 102 is held tightly by the conveyance roller 104 and discharge roller 105. In this case, the paper sheet 102 is pressed with constant force by the conveyance roller 104 and discharge roller 105. In FIG. 3, numeral 302 denotes the force of the conveyance roller 104 and numeral 303 denotes the force of the discharge roller 105. By these force, the distance between the paper sheet 102 and the ink discharge surface of the nozzle unit 202 is set equal on the conveyance roller side 304 and the discharge roller side 305. Keeping this distance uniform can stabilize the printing quality.

FIG. 4 shows a state where printing is performed at the front end of the paper sheet 102. In this case, the paper sheet 102 is held tightly by the conveyance roller 104 only. In other words, the force 302 is imposed on the paper sheet 102 by the conveyance roller 104, but no force is imposed by the discharge roller 105. In this case, the front end of the paper sheet 102 is pulled downward by the gravity, in accordance with the thickness and stiffness (flexibility) of the paper. In the example shown in FIG. 4, the front end of the paper sheet 102 comes in contact with the platen. Because of this, the distance between the paper sheet 102 and the ink discharge surface of the nozzle unit 202 is larger on the discharge roller side 305 than the conveyance roller side 304. The unevenness of the distance causes deterioration in printing quality.

FIG. 5 shows a state where printing is performed at the rear end of the paper sheet 102. In this case, the paper sheet 102 is held tightly by the discharge roller 105 only. In other words, the force 303 is imposed on the paper sheet 102 by the-discharge roller 105, but no force is imposed by the conveyance roller 104. Since the already-discharged part of the paper is pulled downward by the gravity at the discharge roller 105 as a supporting point, the rear end of the paper sheet 102 lifts up as shown in FIG. 5. Because of this, the distance between the paper sheet 102 and the ink discharge surface of the nozzle unit 202 is smaller on the conveyance roller side 304 than the discharge roller side 305. The unevenness of the distance causes deterioration in printing quality.

The present invention is proposed to prevent deterioration of printing quality caused by such unevenness of the distance between the printing surface and the ink discharge surface, which is generated at the time of printing the front end or rear end of a printing medium. Hereinafter, the characteristic configuration and control of the first embodiment is described.

Figure 6:
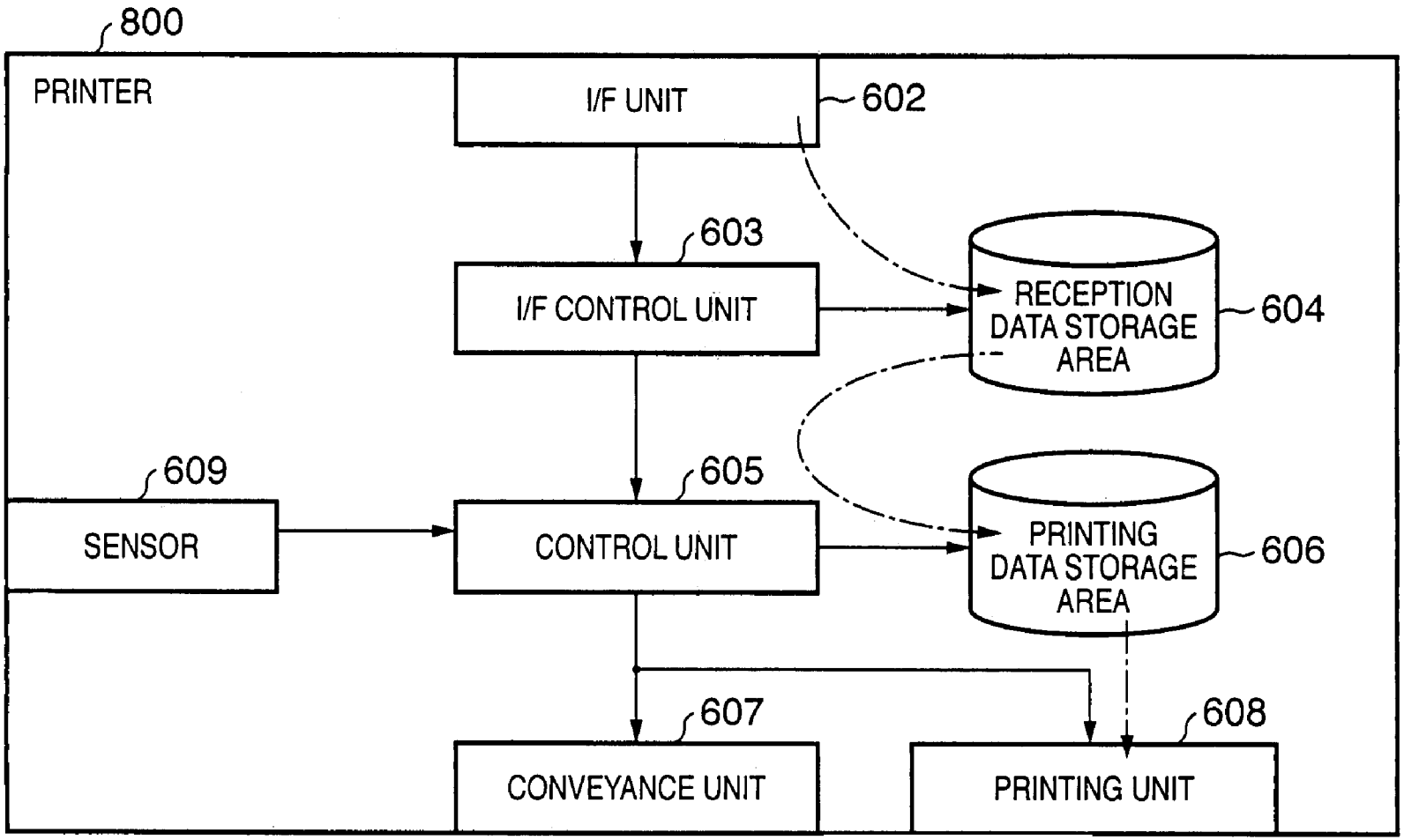
FIG. 6 is a block diagram showing an internal construction of the printing apparatus according to the embodiment.

FIG. 6 is a block diagram showing a control structure of the printing apparatus according to the first embodiment. A printer 800 performs data reception through an I/F unit 602 which inputs or outputs data from or to an external unit, an I/F control unit 603 which controls the I/F unit 602, and a reception data storage area 604 which stores data received through the I/F unit. A control unit 605, which controls the entire printer, generates printing data based on the data stored in the reception data storage area 604, and the generated printing data is stored in a printing data storage area 606. Also, the control unit 605 controls a conveyance unit 607 including the aforementioned conveyance mechanism, and a printing unit 608 including the aforementioned printhead to execute printing on a paper sheet.

In the first embodiment, the control unit 605 differently controls the conveyance unit 607 and the printing unit 608 depending on the position of the printing medium with respect to the conveyance direction, as will be described later. The physical position of the printing medium with respect to the conveyance direction can be determined based upon a command (conveyance distance) given to the conveyance unit 607 generated by the control unit 605, or information from the sensor unit 609. Note that the sensor unit 609 not only includes the sensor 112 described in FIG. 1, but may also include a plurality of sensors provided at plural locations.

Figure 7A:
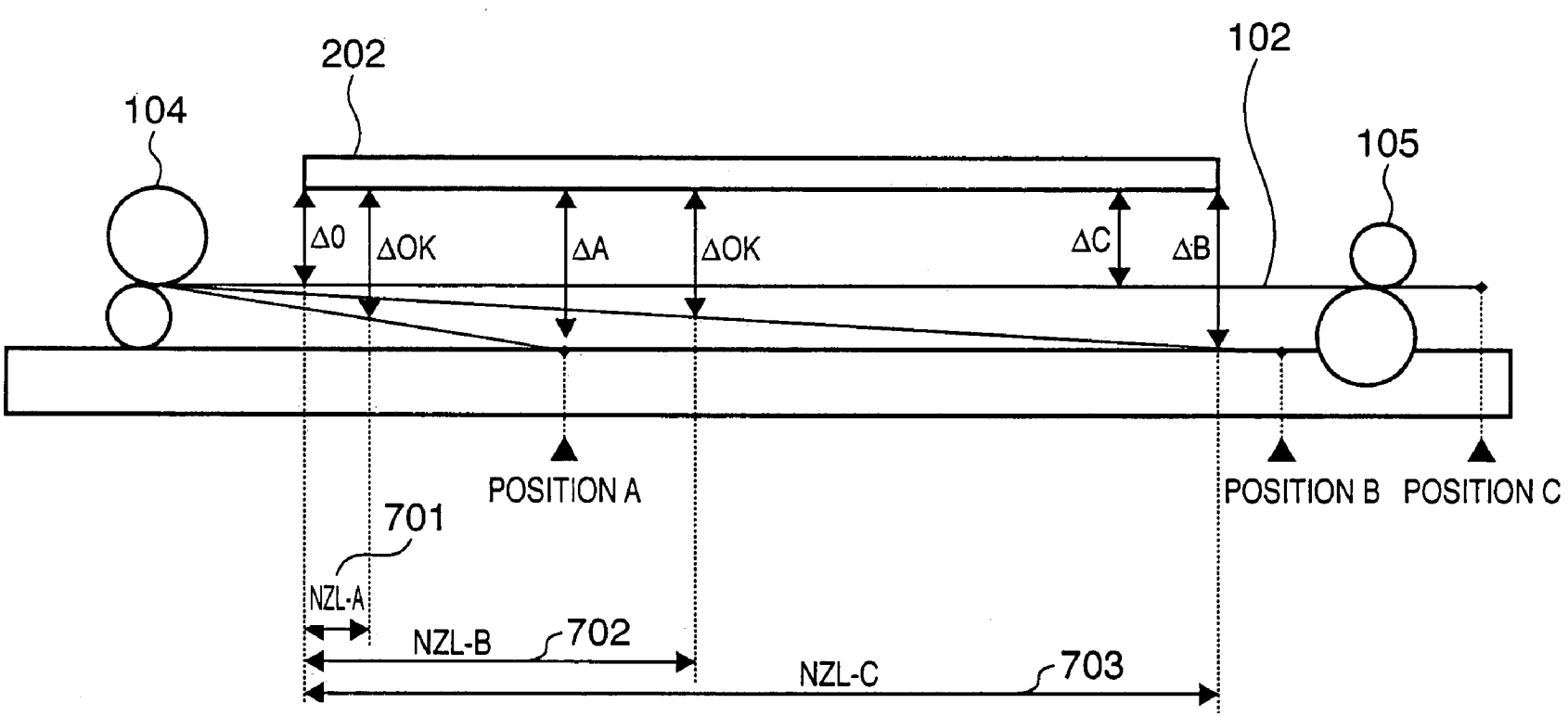
FIG. 7A is an explanatory view of a relation between the paper position and a discharge nozzle according to the embodiment.
Figure 7B:
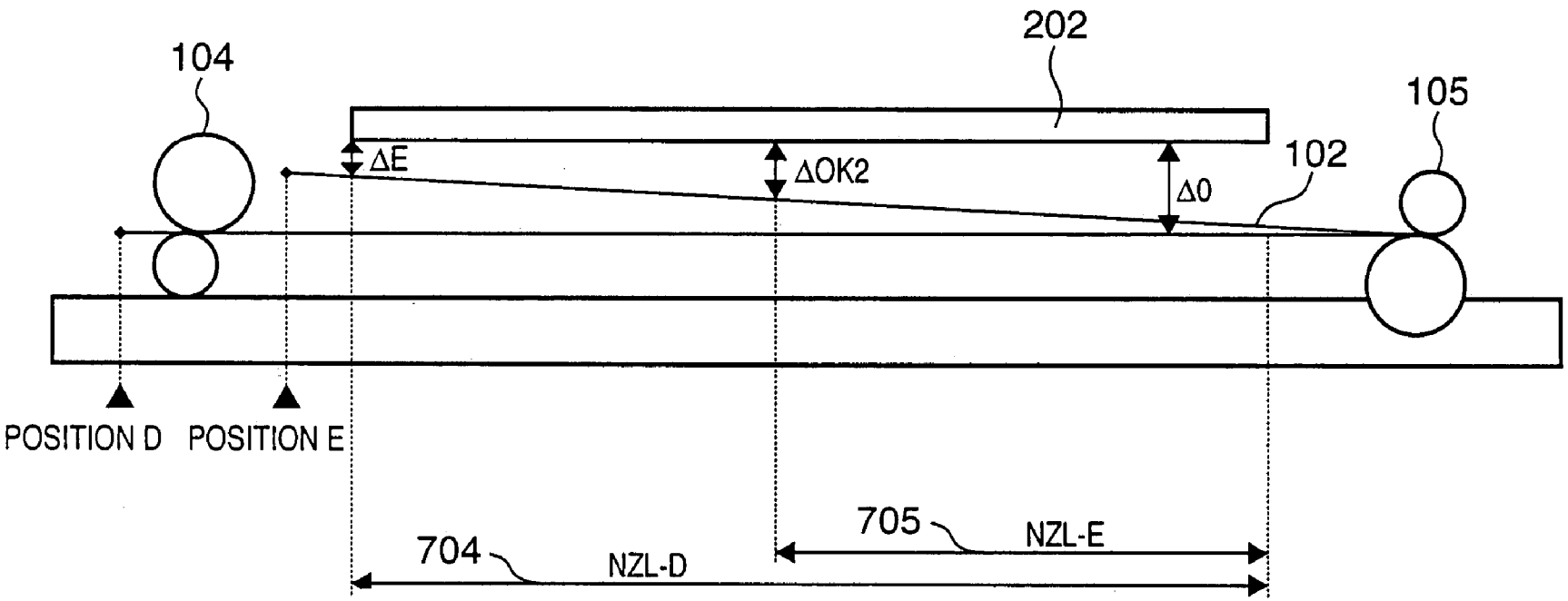
FIG. 7B is an explanatory view of a relation between the paper position and a discharge nozzle according to the embodiment.

Next, a control method according to the first embodiment is described with reference to FIGS. 7A and 7B. FIG. 7A is a schematic view of a state where printing is performed at the front end of the paper sheet 102. FIG. 7B is a schematic view of a state where printing is performed at the rear end of the paper sheet 102.

FIG. 7A shows the cases where the front end of the paper sheet 102 is located at three positions A, B and C. In each of these cases, the maximum distance between the printing surface of the paper sheet 102 and the discharge surface of the nozzle unit 202 is ΔA, ΔB or ΔC. Δ0 indicates the distance between the printing surface and the discharge surface in the normal state. Herein, ΔA>ΔB>ΔC stands, and ΔC=Δ0.

According to the first,embodiment, a maximum distance ΔOK between the printing surface and the discharge surface, in which printing can be performed without conspicuous deterioration in image quality, is determined, and printing is performed on the printing surface where the distance between the printing surface and the discharge surface falls within the permissible range Δ0 to ΔOK. When the front end of the paper is at position A, the distance between the discharge surface and the printing surface falls within ΔOK at the position 701. Therefore, printing is performed using nozzles of the corresponding nozzle area NZL-A. When the front end of the paper is at position B, the distance between the discharge surface and the printing surface falls within ΔOK at the position 702. Therefore, printing is performed using nozzles of the corresponding nozzle area NZL-B. When the front end of the paper passes through the discharge roller 105 as indicated by the position C, printing is performed using nozzles of the all nozzle area NZL-C as indicated by 703.

Similarly, FIG. 7B shows the cases where the rear end of the paper sheet 102 is located at two positions D and E. In each of these cases, the minimum distance between the printing surface of the paper sheet 102 and the discharge surface of the nozzle unit 202 is Δ0 or ΔE. Herein, Δ0>ΔE stands.

A minimum distance ΔOK2 between the printing surface and the discharge surface, in which printing can be performed without conspicuous deterioration in image quality, is determined, and printing is performed on the printing surface where the distance between the printing surface and the discharge surface falls within the permissible range ΔOK2 to Δ0. When the rear end of the paper is at position D, printing is performed using nozzles of the all nozzle area NZL-D as indicated by 704. When the rear end of the paper is at position E, the distance between the discharge surface and the printing surface falls within ΔOK2 at the position 705. Therefore, printing is performed using nozzles of the corresponding nozzle area NZL-E.

Note that the values of the maximum distance ΔOK and minimum distance ΔOK2 between the printing surface and the discharge surface depend upon the discharge performance and mechanism of a printhead, and thus differ for each printhead and apparatus used. Since it is preferable that the values be set in accordance with the configuration of the actual apparatus, specific values are not mentioned herein.

Hereinafter, a detailed description will be provided on controlling the nozzles to be used in accordance with the position of a paper sheet-according to the first embodiment.

Note that the position of a paper sheet may be of a logical position based on a command generated by the control unit or a position physically detected by the sensor. The first embodiment assumes that the number of all nozzles of the nozzle unit 202 is 90, and that the nozzles to be used in printing can be set in units of 10 nozzles. Assume that the nozzle numbers 1 to 90 are assigned in ascending order from the discharge roller side to the conveyance roller side.

Figure 14:
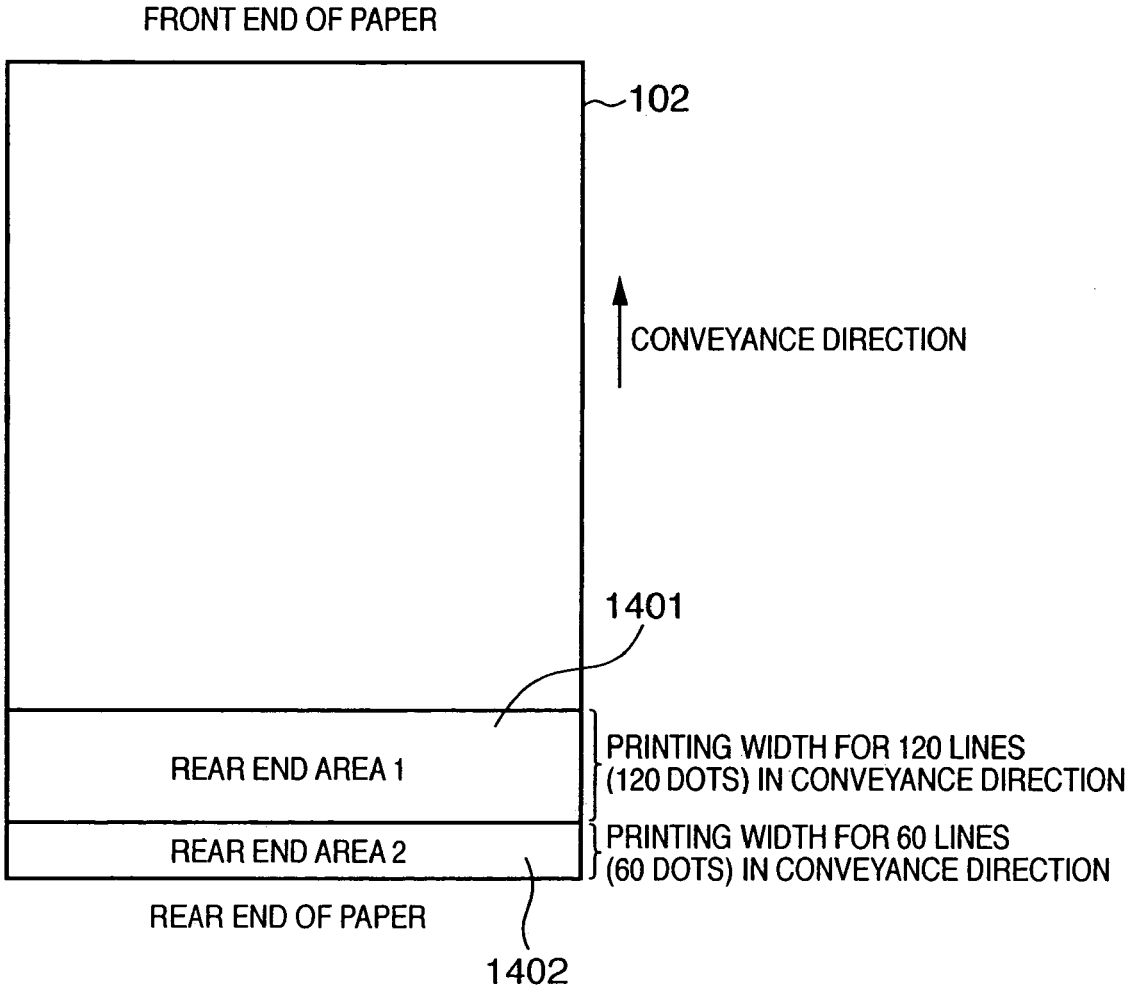
FIG. 14 is a view showing an area subjected to rear end processing according to the first embodiment.

FIG. 14 shows an area subjected to rear end processing on the paper sheet 102 that is used as a printing medium. In the first embodiment, the area subjected to rear end processing is the rear end area 1 and rear end area 2. The rear end area 2, indicated by numeral 1402, is an area corresponding to the width of 60 nozzles (60 rasters or 60 lines) from the rear end of the paper sheet. The rear end area 1, indicated by numeral 1401, is an area corresponding to the width of 120 rasters from the rear end area 2 to the front-end side.

Figure 8:
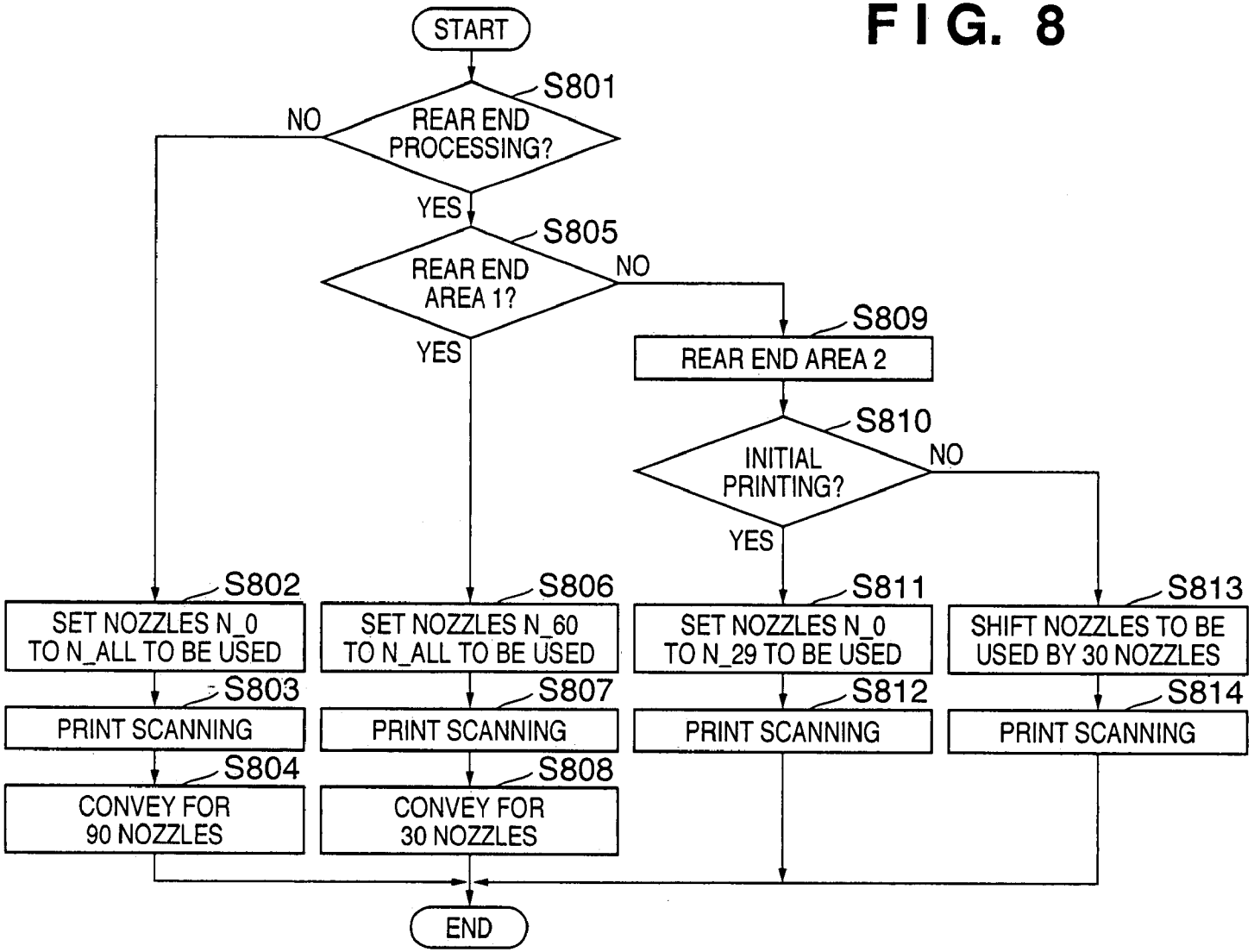
FIG. 8 is a flowchart describing a printing process according to the first embodiment.

FIG. 8 is a flowchart for performing a printing operation on a printing medium according to the first embodiment. Note that the flowchart describes the process corresponding to only one time of print scanning. Printing on a sheet of printing medium is completed by repeating a series of processes in accordance with an image size printed on the printing medium.

In step S801, it is determined whether or not to perform rear end processing (rear end printing). The determination is made based on a position of the printing medium with respect to the conveyance direction. If it is determined that rear end processing is not to be performed, then in step S802, setting is made to use all nozzles (90 nozzles). In step S803, print scanning is performed. In step S804, the printing medium is conveyed for the width of 90 nozzles.

When it is determined in step S801 that rear end processing is to be performed, then in step S805, it is determined whether or not the area to be printed is the rear end area 1. If YES, the control proceeds to step S806, and setting is made to use 30 nozzles (61st nozzle (N_60) to 90th nozzle (N_ALL)). In step S807, print scanning is performed. In step S808, the printing medium is conveyed for the width of 30 nozzles.

In step S805, if it is determined that the area to be printed is not the rear end area 1, the control proceeds to step S809 where processing for the rear end area 2 is started. In step S810, it is determined whether or not it is an initial printing of the rear end area 2. If YES, the control proceeds to step S811, and setting is made to use 30 nozzles (1st nozzle (N_0) to 30th nozzle (N_29)). In step S812, print scanning is performed.

The reason that the nozzle numbers 1 to 30 are used herein is because the distance between the printing surface and the discharge surface is closer to Δ0 on the discharge roller side than the conveyance roller side, as described above with reference to FIG. 7B.

If it is determined in step S810 that it is not an initial printing of the rear end area 2, the control proceeds to step S813 where nozzles to be used are shifted by 30 nozzles. In step S814, print scanning is performed. As described above, when the rear end area 2 is printed, the nozzles to be used are shifted instead of conveying the paper sheet (printing medium), thereby printing an image to the last edge.

Figure 10:
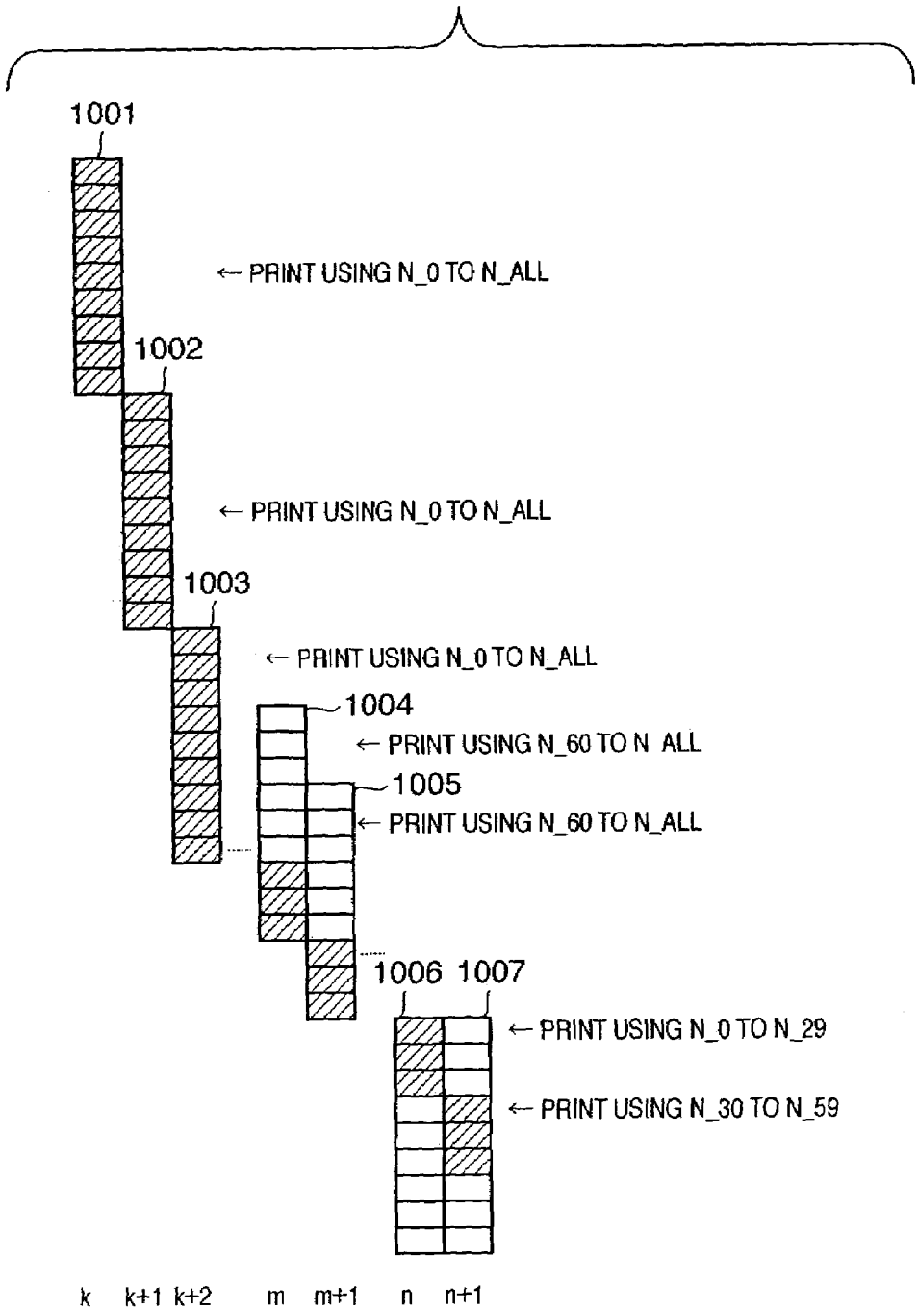
FIG. 10 is a view showing nozzles to be used in respective scanning executed according to the first embodiment, and relative positions between a nozzle unit and a printing medium.

FIG. 10 shows nozzles to be used in respective scanning executed in accordance with the flowchart in FIG. 8, and relative positions between the nozzle unit and the printing medium. In the drawing, the nozzle numbers 1 to 90 are assigned in ascending order from the upper side to the lower side, and one grid represents 10 nozzles. Hatched portion represents nozzles to be used in respective scanning. In the drawing, the downward movement of the nozzle unit represents changes in the relative positions between the nozzle unit and the printing medium as the printing medium is conveyed. The reference letters k, m and n at the bottom of FIG. 10 indicate a print scanning number. Print scanning is performed in order of k, k+1, k+2, . . . , m, m+1, . . . , n, n+1, n+2 and so on.

Reference numerals 1001, 1002 and 1003 in FIG. 10 correspond to the print scanning performed in step S803, which is not the rear end processing. Reference numerals 1004 and 1005 correspond to the print scanning performed in step S807, which is executed for the rear end area 1. Reference numerals 1006 and 1007 correspond to the print scanning performed in steps S812 and S814, which are executed for the rear end area 2.

The rear end area 1 corresponds to the area which is printed immediately after the rear end of the printing medium passes through the conveyance roller. To print the rear end area 1, the printing width (i.e., conveying distance) corresponding to one time of print scanning is set small. When the rear end area 2 is printed, since the distance between the discharge surface of the 60th nozzle and the printing surface of the rear end of the printing medium (or a rear end of the area subjected to image printing) is ΔOK2, printing is performed while shifting the nozzles to be used, instead of conveying the printing medium.

As described above, according to the first embodiment, when the rear end of a printing medium passes through the conveyance roller and the printing medium is held only by the discharge roller, printing is performed while shifting the nozzles to be used, instead of conveying the printing medium. By virtue of this process, fluctuation of the distance between the nozzle discharge surface and the printing surface of the rear end of the printing medium, which is caused by conveyance of the printing medium, can be prevented, and printing can be performed with a stable printing surface.

As has been set forth above, according to the first embodiment, it is possible to prevent deterioration of printing quality at the time of printing the rear end of a printing medium, in which the distance between the discharge surface and the printing surface is unstable.

Second Embodiment

Hereinafter, the second embodiment of the present invention is described. The second embodiment also adopts an inkjet printing apparatus similar to that of the first embodiment. The following description will be provided mainly on the part different from the first embodiment.

Figure 15:
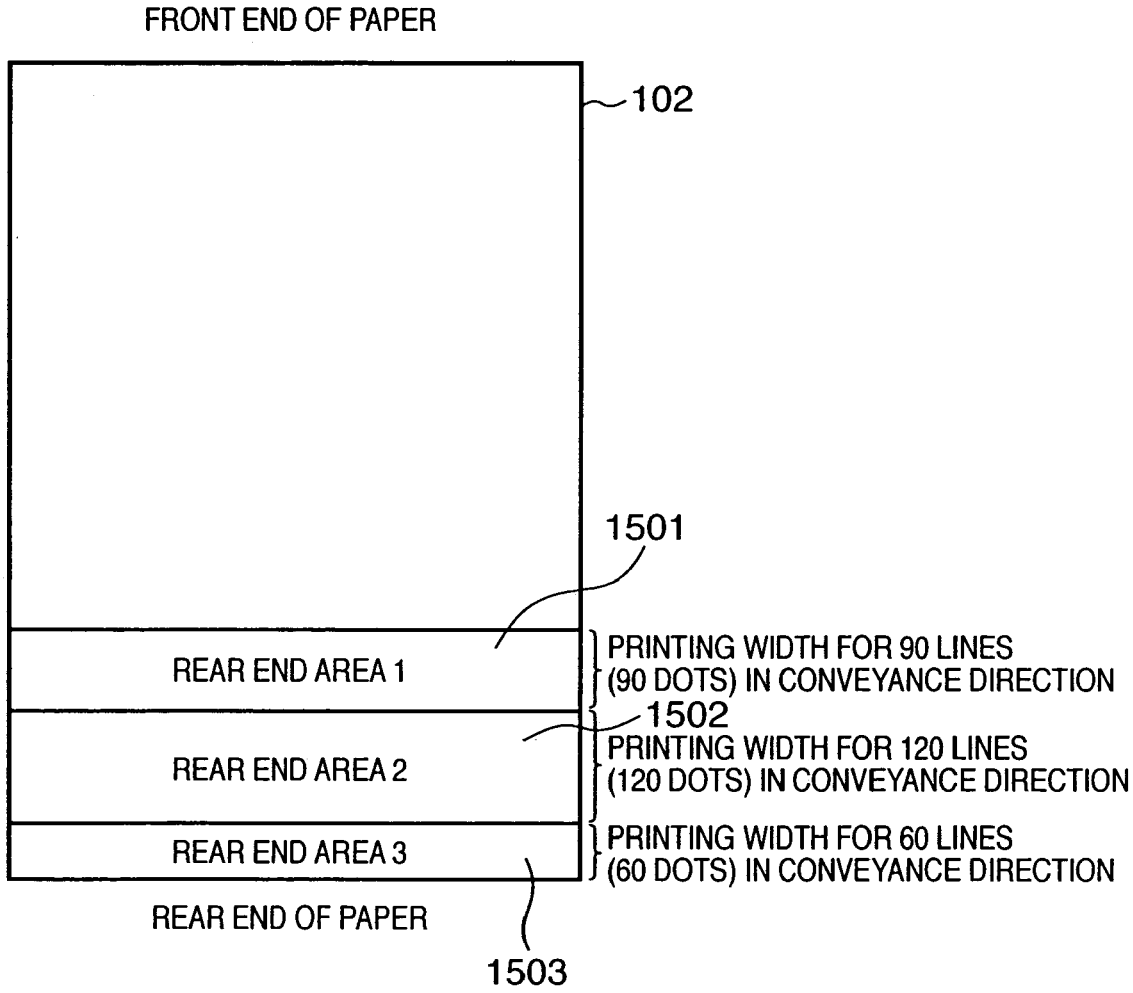
FIG. 15 is a view showing an area subjected to rear end processing according to the second embodiment.

FIG. 15 shows an area subjected to rear end processing on the paper sheet 102 that is used as a printing medium. In the second embodiment, the area subjected to rear end processing is the rear end area 1, rear end area 2, and rear end area 3. The rear end area 3, indicated by numeral 1503, is an area corresponding to the width of 60 nozzles (60 rasters or 60 lines) from the rear end of the paper sheet. The rear end area 2, indicated by numeral 1502, is an area corresponding to the width of 120 rasters from the rear end area 3 to the front-end side. The rear end area 1, indicated by numeral 1501, is an area corresponding to the width of 90 rasters from the rear end area 2 to the front-end side.

Figure 9:
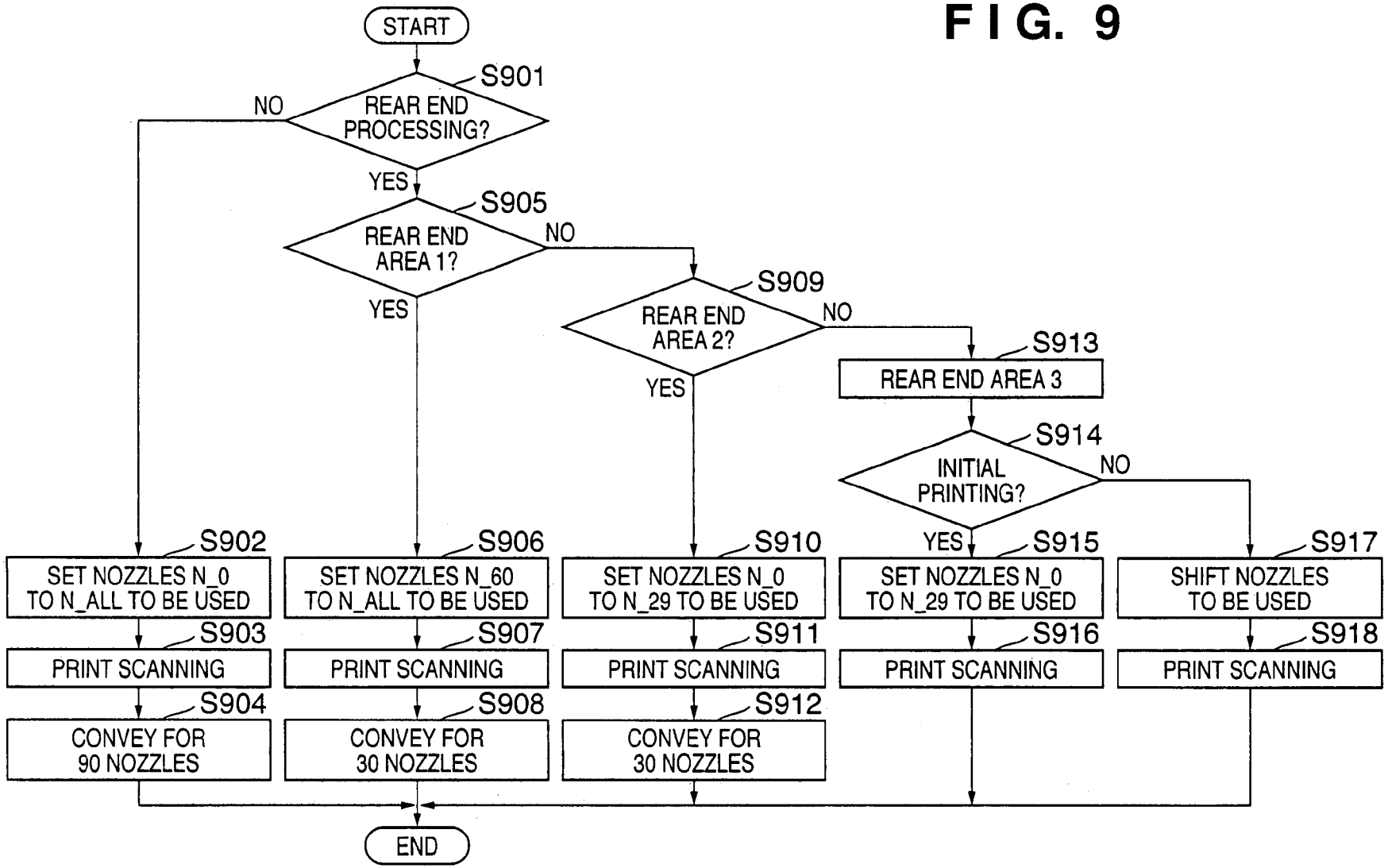
FIG. 9 is a flowchart describing a printing process according to the second embodiment.

FIG. 9 is a flowchart for performing a printing operation on a printing medium according to the second embodiment. Note that the flowchart describes only the process corresponding to one time of print scanning. Printing on a sheet of printing medium is completed by repeating a series of processes in accordance with an image size printed on the printing medium.

In step S901, it is determined whether or not to perform rear end processing (rear end printing). The determination is made based on a position of the printing medium with respect to the conveyance direction. If it is determined that rear end processing is not to be performed, then in step S902, setting is made to use all nozzles (90 nozzles). In step S903, print scanning is performed. In step S904, the printing medium is conveyed for the width of 90 nozzles.

When it is determined in step S901 that rear end processing is to be performed, then in step S905, it is determined whether or not the area to be printed is the rear end area 1. If YES, the control proceeds to step S906, and setting is made to use 30 nozzles (61st nozzle (N_60) to 90th nozzle (N_ALL)). In step S907, print scanning is performed. In step S908, the printing medium is conveyed for the width of 30 nozzles.

In step S905, if it is determined that the area to be printed is not the rear end area 1, the control proceeds to step S909 where it is determined whether or not the area to be printed is the rear end area 2. If YES, the control proceeds to step S910, and setting is made to use 30 nozzles (1st nozzle (N_0) to 30th nozzle (N_29)). In step S911, print scanning is performed. In step S912, the printing medium is conveyed for the width of 30 nozzles.

In step S909, if it is determined that the area to be printed is not the rear end area 2, then the area to be printed is the rear end area 3. In step S914, it is determined whether or not it is an initial printing of the rear end area 3. If YES, the control proceeds to step S915, and setting is made to use 30 nozzles (1st nozzle (N_0) to 30th nozzle (N_29)). In step S916, print scanning is performed.

If it is determined in step S914 that it is not an initial printing of the rear end area 3, the control proceeds to step S917 where nozzles to be used are shifted by 30 nozzles. In step S918, print scanning is performed. As described above, when the rear end area 3 is printed, the nozzles to be used are shifted instead of conveying the paper sheet (printing medium), thereby printing an image to the last edge.

Figure 11:
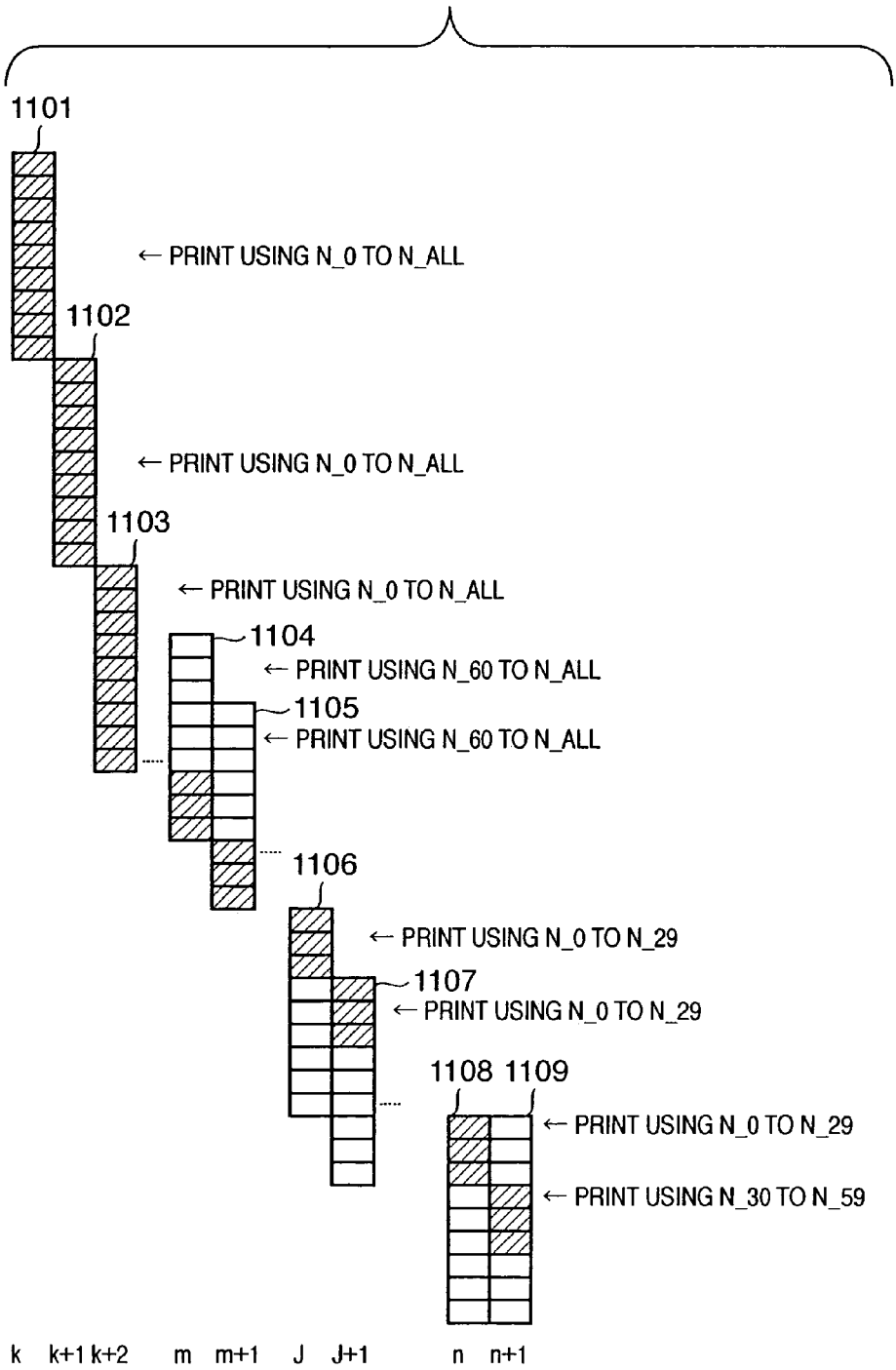
FIG. 11 is a view showing nozzles to be used in respective scanning executed according to the second embodiment, and relative positions between a nozzle unit and a printing medium.

FIG. 11 shows nozzles to be used in respective scanning executed in accordance with the flowchart in FIG. 9, and relative positions between the nozzle unit and the printing medium, as similar to FIG. 10. Hatched portion represents nozzles to be used in respective scanning.

Reference numerals 1101, 1102 and 1103 in FIG. 11 correspond to the print scanning performed in step S903, which is not the rear end processing. Reference numerals 1104 and 1105 correspond to the print scanning performed in step S907, which is executed for the rear end area 1. Reference numerals 1106 and 1107 correspond to the print scanning performed in step S911, which is executed for the rear end area 2. Reference numerals 1108 and 1109 correspond to the print scanning performed in steps S916 and S918, which are executed for the rear end area 3.

The rear end area 1 corresponds to the area which is printed when the rear end of the printing medium is approaching the conveyance roller, as indicated by position D in FIG. 7B. The rear end area 2 corresponds to the area which is printed immediately after the rear end of the printing medium passes through the conveyance roller. To print these areas, the printing width (i.e., conveying distance) corresponding to one time of print scanning is set small. When the rear end area 3 is printed, since the distance between the discharge surface of the 60th nozzle and the printing surface of the rear end of the printing medium (or a rear end of the area subjected to image printing) is ΔOK2, printing is performed while shifting the nozzles to be used, instead of conveying the printing medium.

As described above, according to the second embodiment, when the rear end of a printing medium passes through the conveyance roller and the printing medium is held only by the discharge roller, printing is performed while shifting the nozzles to be used, instead of conveying the printing medium. By virtue of this process, fluctuation of the distance between the nozzle discharge surface and the printing surface of the rear end of the printing medium, which is caused by conveyance of the printing medium, can be prevented, and printing can be performed with a stable printing surface. In other words, the effect similar to that of the first embodiment can be achieved.

First Modified Embodiment

Although the above embodiments have described the control for performing printing at the rear end of a printing medium, the present invention is also applicable to the control for performing printing at the front end of a printing medium.

Figure 12:
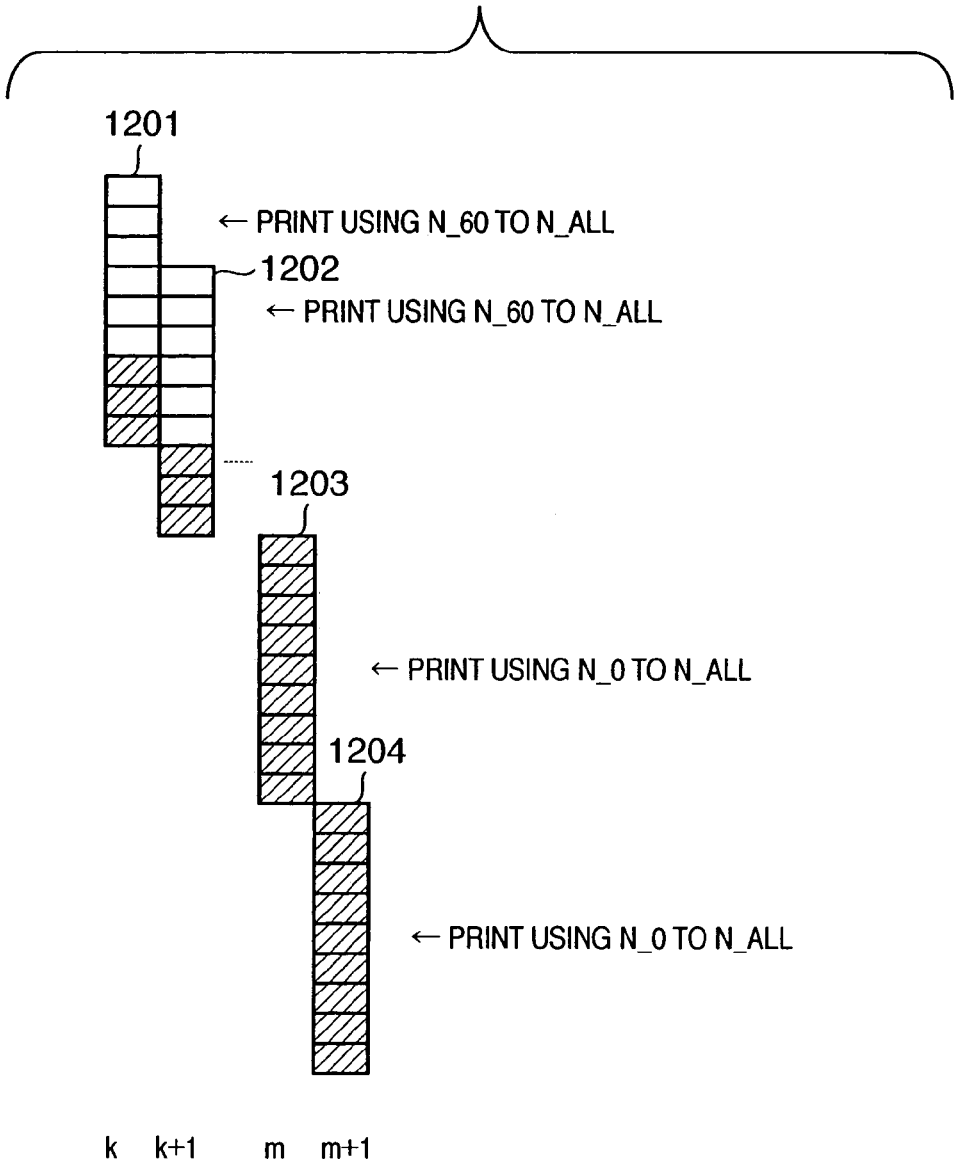
FIG. 12 is a view showing nozzles to be used in respective scanning executed according to the first modified embodiment, and relative positions between a nozzle unit and a printing medium.

FIG. 12 shows nozzles to be used for printing the front end of a printing medium, and relative positions between the nozzle unit and the printing medium, as similar to FIG. 10. This example assumes that the printing medium is held only by the conveyance roller as shown in FIG. 7A, and that the nozzles satisfying the distance between the printing surface and the discharge surface that is equal to or smaller than ΔOK are 61st to 90th nozzles on the conveyance roller side. Print scanning 1201 and 1202 is performed plural numbers of times using these 30 nozzles. After the front end of the printing medium is held by the discharge roller, print scanning 1203 and 1204 is performed using all nozzles.

According to the first modified embodiment, it is possible to prevent deterioration of printing quality at the time of printing the front end of a printing medium, in which the distance between the discharge surface and the printing surface is unstable.

Second Modified Embodiment

In the first and second embodiments, the size of the rear end area printed in a state where the rear end of the printing medium passes through the conveyance roller and is held only by the discharge roller is 60 rasters. However, since the size of the rear end area corresponds to the nozzle numbers satisfying the distance Δ0 between the printing-surface at the rear end and the discharge surface, the size of the rear end area varies depending on the size of the printing medium (particularly the length in the scanning direction) and the types (material, thickness and so on) of the printing medium.

Figure 13:
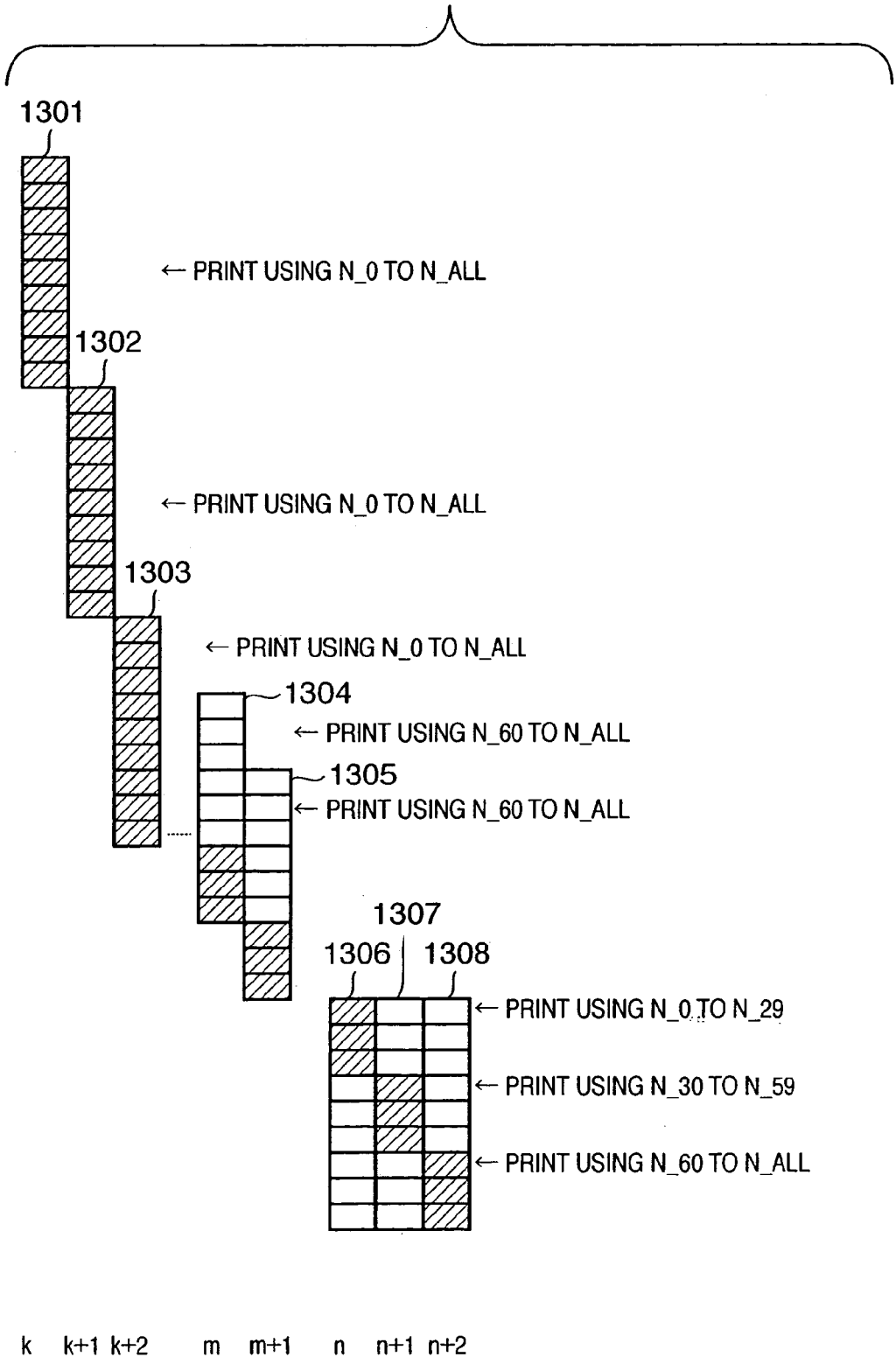
FIG. 13 is a view showing nozzles to be used in respective scanning executed according to the second modified embodiment, and relative positions between a nozzle unit and a printing medium.

For instance, in a case where the size of the rear end area 2 corresponds to 90 rasters as in the first embodiment, print scanning is performed three times while shifting the nozzles to be used by 30 nozzles. FIG. 13 shows nozzles to be used for printing the rear end of a printing medium according to the second modified embodiment, and relative positions between the nozzle unit and the printing medium, as similar to FIG. 10. In FIG. 13, numerals 1306, 1307 and 1308 corresponds to print scanning for the rear end area 2.

Note that setting parameters of the rear end area (i.e., printing medium conveying distance at the rear end and nozzles to be used) are determined in advance based on test printing or simulations for each printing medium or based on a predetermined operation, and the obtained information is stored as a table in the memory. The parameters are read out of the memory in accordance with the printing medium employed.

Other Embodiment

Although the above embodiments have described a case where the nozzle unit of the printhead has 90 nozzles, the number of nozzles of the printhead is not limited to this. The present invention is also applicable to a printing apparatus which performs printing by a printhead having a large number of nozzles, e.g., 128, 256 or the like. Furthermore, the present invention is also applicable to a case of using a printhead having a number of nozzle columns corresponding to the number of types of inks employed.

Moreover, although the above embodiments have described one-pass printing where each area is printed by one time of scanning, the present invention is applicable to multi-pass printing where each area is printed by plural times of scanning. Furthermore, in the first embodiment, when printing proceeds to the rear end area 1 from the area before the rear end area 1 (FIG. 10), the number of nozzles employed is changed from 90 nozzles to 30 nozzles (1004). However, the number of nozzles employed in the print scanning before the rear end area 1 may be gradually reduced to, e.g., 70 (N_0 to N_69), 50 (N_0 to N_49), and 30 (N_0 to N_29). In this control, the printing medium is conveyed for the amount corresponding to the number of nozzles.

The present invention can be applied to a system comprising a plurality of devices or to an apparatus comprising a single device.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Examples of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

If the present invention is realized as a storage medium, program codes corresponding to the above mentioned flowcharts (FIG. 8 and/or FIG. 9) are to be stored in the storage medium.

As many apparently widely different embodiments of the present invention can be made without departing from the spirit and scope thereof, it is to be understood that the invention is not limited to the specific embodiments thereof except as defined in the appended claims.

What is claimed is:

1. An inkjet printing apparatus, having a carriage incorporating an inkjet printhead where nozzles for discharging ink are arranged in a predetermined direction, for performing printing by scanning the carriage with respect to a printing medium in a direction orthogonal to the predetermined direction, comprising:

first and second conveyance means, arranged at an upstream side and a downstream side, respectively, with respect to a printing-medium conveyance direction of an area of the printing medium scanned by the printhead, for conveying the printing medium while holding the printing medium; and nozzle setting means for, when the printing medium is held only by said second conveyance means, setting nozzles to be used for printing by selecting from the nozzles of the printhead arranged at the downstream side in the printing-medium conveyance direction, in accordance with a position of the printing medium in the printing-medium conveyance direction, wherein said nozzle setting means, when printing a rear side of the printing medium, changes the nozzles to be used for printing at each scan of the printhead, and during the plural times of scanning, nozzles to be used for printing are changed, instead of conveying the printing medium by at least one of said first and second conveyance means.

2. The inkjet printing apparatus according to claim 1, wherein said nozzle setting means makes a setting to use all nozzles when the printing medium is held by both said first and second conveyance means.

3. The inkjet printing apparatus according to claim 1, wherein said nozzle setting means further comprises an association table associating a nozzle to be used and a distance with respect to the printing-medium conveyance direction for each type of printing medium.

4. A control method of an inkjet printing apparatus, having a carriage incorporating an inkjet printhead where nozzles for discharging ink are arranged in a predetermined direction, for performing printing by scanning the carriage with respect to a printing medium in a direction orthogonal to the predetermined direction, the apparatus having first and second conveyance means that are arranged at an upstream side and a downstream side, respectively, with respect to a printing-medium conveyance direction of an area of the printing medium scanned by the printhead, comprising:

a determining step of determining whether or not the printing medium is held only by the second conveyance means based on a position of the printing medium in the printing-medium conveyance direction; and a nozzle setting step of, when said determining step determines that the printing medium is held only by the second conveyance means, setting nozzles to be used for printing by selecting from the nozzles of the printhead arranged at the downstream side in the printing-medium conveyance direction, in accordance with a position of the printing medium in the printing-medium conveyance direction, wherein said nozzle setting step, when printing a rear side of the printing medium, changes the nozzles to be used for printing at each scan of the printhead, and during the plural times of scanning, nozzles to be used for printing are changed, instead of conveying the printing medium by at least one of the first and second conveyance means.

5. An inkjet printing apparatus, having a carriage incorporating an inkjet printhead where nozzles for discharging ink are arranged in a predetermined direction, for performing printing by scanning the carriage with respect to a printing medium in a direction orthogonal to the predetermined direction, comprising:

first and second conveyance means, arranged at an upstream side and a downstream side, respectively, with respect to a printing-medium conveyance direction of an area of the printing medium scanned by the printhead, for conveying the printing medium while holding the printing medium; and selecting means for, when the printing medium is held only by said second conveyance means, selecting nozzles to be used for printing from the nozzles of the printhead arranged at the downstream side in the printing-medium conveyance direction, in accordance with a position of the printing medium in the printing-medium conveyance direction, wherein said nozzle selecting means, when printing a rear side of the printing medium, changes selection of the nozzles to be used for printing at each scan of the printhead, and during the plural times of scanning, nozzles to be used for printing are changed, instead of conveying the printing medium by at least one of said first and second conveyance means.

* * * * *